US008126362B2

(12) United States Patent
Jones et al.

(10) Patent No.: US 8,126,362 B2
(45) **Date of Patent: *Feb. 28, 2012**

(54) SYSTEM AND METHOD FOR MEASURING MEDIA THICKNESS WITH A TRANSFER SUBSYSTEM IN A PRINTER

(75) Inventors: Michael E. Jones, West Linn, OR (US); Sara M. Haislip, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 704 days.

This patent is subject to a terminal disclaimer.

(21) Appl. No.: 12/212,218

(22) Filed: Sep. 17, 2008

(65) Prior Publication Data

US 2010/0067948 A1 Mar. 18, 2010

(51) Int. Cl.
*G03G 15/08* (2006.01)

(52) U.S. Cl. ..... 399/121; 399/66; 399/297; 399/110

(58) Field of Classification Search ..... 399/110, 399/121, 297, 66

See application file for complete search history.

(56) References Cited

U.S. PATENT DOCUMENTS

| | | | | |
|---|---|---|---|---|
| 6,381,423 | B1 * | 4/2002 | Eom | 399/45 |
| 6,389,242 | B1 * | 5/2002 | Watanabe | 399/45 |
| 6,585,368 | B1 | 7/2003 | Park | |
| 6,731,891 | B1 | 5/2004 | Calamita et al. | |
| 7,061,637 | B2 * | 6/2006 | Mochimaru et al. | 358/1.15 |
| 7,860,417 | B2 * | 12/2010 | Jones et al. | 399/66 |
| 2004/0001917 | A1 | 1/2004 | Urlaub et al. | |
| 2006/0238585 | A1 | 10/2006 | Kohne et al. | |
| 2007/0018383 | A1 * | 1/2007 | Ohara et al. | 271/262 |
| 2007/0109383 | A1 | 5/2007 | Folkins et al. | |
| 2007/0139496 | A1 | 6/2007 | Leighton et al. | |
| 2008/0187364 | A1 * | 8/2008 | Yamanaka et al. | 399/223 |

* cited by examiner

*Primary Examiner* — David Gray
*Assistant Examiner* — Roy Y Yi
(74) *Attorney, Agent, or Firm* — Maginot, Moore & Beck, LLP

(57) ABSTRACT

A printer and method have been developed that enable a controller in a printer to compute a thickness of an image substrate. The printer includes an intermediate imaging member, a transfer roller located proximate to the intermediate imaging member, a displaceable linkage coupled to the transfer roller to move the transfer roller from a first position to a position in which the transfer roller forms a transfer nip with the intermediate imaging member and to return the transfer roller to the start position, and a controller coupled to the displaceable linkage, the controller being configured to measure movement of the transfer roller from the first position to the position where the transfer nip is formed, and to compute a media thickness from a measured movement of the transfer roller from the first position to the position where the transfer nip is formed with the intermediate imaging member without an image substrate being in the transfer nip and a measured movement of the transfer roller from the first position to the position where the transfer nip is formed with an image substrate in the transfer nip between the transfer roller and the intermediate imaging member.

20 Claims, 5 Drawing Sheets

SYSTEM AND METHOD FOR MEASURING MEDIA THICKNESS WITH A TRANSFER SUBSYSTEM IN A PRINTER

TECHNICAL FIELD

This disclosure relates generally to printers having an intermediate imaging member and, more particularly, to the components and methods for transferring an image from an intermediate imaging member to print media.

BACKGROUND

Solid ink or phase change ink printers conventionally receive ink in a solid form, either as pellets or as ink sticks. The solid ink pellets or ink sticks are placed in a feed chute and delivered to a heater assembly. Delivery of the solid ink may be accomplished using gravity or an electromechanical or mechanical mechanism or a combination of these methods. At the heater assembly, a heater plate melts the solid ink impinging on the plate into a liquid that is collected and conveyed to a print head for jetting onto a recording medium.

In known printing systems having an intermediate imaging member, the print process includes an imaging phase, a transfer phase, and an overhead phase. In ink printing systems, the imaging phase is the portion of the print process in which the ink is expelled through the piezoelectric elements comprising the print head in an image pattern onto the print drum or other intermediate imaging member. The transfer or transfer phase is the portion of the print process in which the ink image on the imaging member is transferred to the recording medium. The image transfer typically occurs by bringing a transfer roller into contact with the image member to form a transfer nip. A recording medium arrives at the nip as the imaging member rotates the image through the transfer nip. The pressure in the nip helps transfer the malleable image inks from the imaging member to the recording medium. When the image area of an image recording substrate has passed through the transfer nip, the overhead phase begins. The transfer roller may be immediately retracted from the imaging member as the trailing edge of the substrate passes through the nip, or it may continue to roll against the imaging member at a reduced force and then be retracted. The transfer roller and/or intermediate imaging member may be, but is not necessarily, heated to facilitate transfer of the image. In some printers, the transfer roller is called a fusing roller. For simplicity, the term "transfer roller" as used herein generally refers to all heated or unheated rollers used to facilitate transfer of an image to a recording media sheet or fusing the image to a sheet.

Many printers have multiple trays in which different types of recording media are stored. These different media may be different sizes of paper or polymer film recording media. These various media also have different thicknesses. As these various media are retrieved from their source trays, transported through the printer, passed through the transfer nip, and dropped into the output tray, they affect printing process parameters. The process parameters affected by different media thicknesses include transfer load, imaging member velocity during the transfer phase, imaging member temperature, and media pre-heater temperature, for example. In some printers, the operator is required to provide media thickness information through a user interface. Operator entry of parameters is subject to a risk of error and also burdens the operator with another aspect of printer management. To reduce requirements for operator interaction, some printers require the operator to select a thick or thin media mode of operation. While this type of operator interaction is an improvement, it still requires a subjective determination from the operator as to whether the thick or thin mode is optimal and does not enable more exact printing process parameter adjustments to be made.

SUMMARY

A printer and method have been developed that measure media in the printer with the transfer subsystem to enable more precise printing process parameter adjustment. The printer includes an intermediate imaging member, a transfer roller located proximate to the intermediate imaging member, a displaceable linkage coupled to the transfer roller to move the transfer roller from a first position to a position in which the transfer roller forms a transfer nip with the intermediate imaging member and to return the transfer roller to the start position, and a controller coupled to the displaceable linkage, the controller being configured to measure movement of the transfer roller from the first position to the position where the transfer nip is formed, and to compute a media thickness from a measured movement of the transfer roller from the first position to the position where the transfer nip is formed with the intermediate imaging member without an image substrate being in the transfer nip and a measured movement of the transfer roller from the first position to the position where the transfer nip is formed with an image substrate in the transfer nip between the transfer roller and the intermediate imaging member.

A method that may be implemented with the printer includes measuring a first movement of a transfer roller from a first position to a position where the transfer roller contacts an intermediate imaging member to form a transfer nip, measuring a second movement of a transfer roller from the first position to a position where the transfer roller contacts an image substrate in the transfer nip; and computing a thickness for the image substrate from the first measured movement and the second measured movement.

BRIEF DESCRIPTION OF THE DRAWINGS

The foregoing aspects and other features of an ink printer implementing a system and method for measuring media thickness using two distances traveled by a transfer roller are explained in the following description, taken in connection with the accompanying drawings.

DETAILED DESCRIPTION

Figure 1:
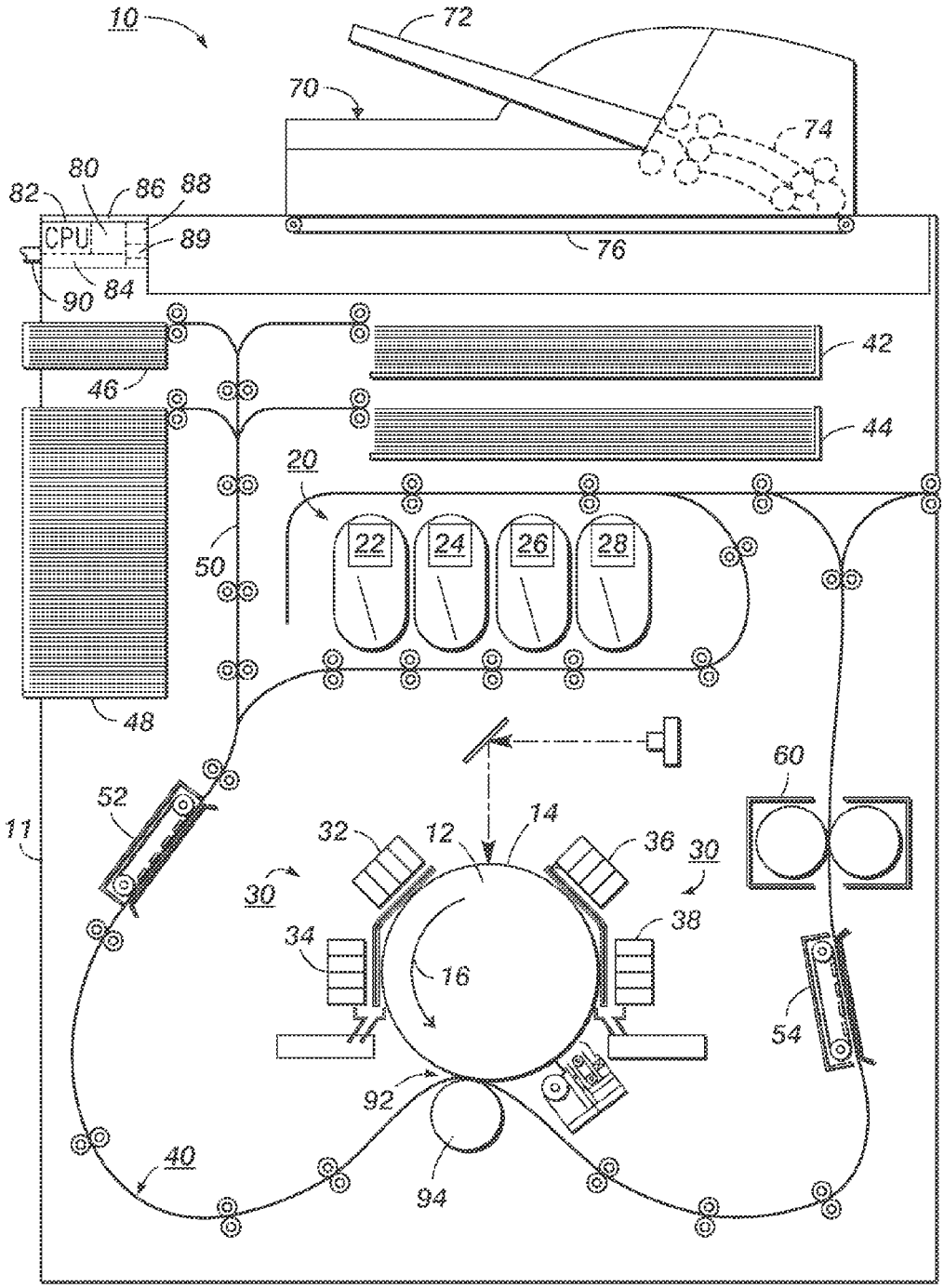
FIG. 1 PRIOR ART
FIG. 1 is a system diagram of a solid ink printer depicting the major subsystems of the ink printer.

FIG. 1 shows a system diagram of a prior art ink printer 10 that may be modified to measure thickness of an image substrate with a transfer roller. The reader should understand that the embodiment of the print process discussed below may be implemented in many alternate forms and variations. In addition, any suitable size, shape or type of elements or materials may be used.

Referring now to FIG. 1, an image producing machine, such as the high-speed phase change ink image producing machine or printer 10, is shown. As illustrated, the machine 10 includes a frame 11 to which are mounted directly or indirectly the operating subsystems and components described below. The high-speed phase change ink image producing machine or printer 10 includes an intermediate imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus for melting or phase changing the solid form of the phase change ink into a liquid form, and then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

With continued reference to FIG. 1, the phase change ink image producing machine or printer 10 includes a substrate supply and handling system 40. The substrate supply and handling system 40, for example, may include substrate supply sources 42, 44, 46, 48, of which supply source 48, for example, is a high capacity paper supply or feeder for storing and supplying image receiving substrates in the form of cut sheets, for example. The substrate supply and handling system 40 includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated microcomputer having a central processor unit (CPU) 82, electronic storage 84, and a display or user interface (UI) 86. The ESS or controller 80, for example, includes sensor input and control means 88 as well as a pixel placement and control means 89. In addition, the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

The controller may be a general purpose microprocessor that executes programmed instructions that are stored in a memory. The controller also includes the interface and input/output (I/O) components for receiving status signals from the printer and supplying control signals to the printer components. Alternatively, the controller may be a dedicated processor on a substrate with the necessary memory, interface, and I/O components also provided on the substrate. Such devices are sometimes known as application specific integrated circuits (ASIC). The controller may also be implemented with appropriately configured discrete electronic components or primarily as a computer program or as a combination of appropriately configured hardware and software components. The programmed instructions stored in the memory of the controller also configure the controller to measure two distances traveled by the transfer roller and to calculate a thickness for an image substrate from the two distances.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 46, 48 and handled by subsystem 50 in timed registration with image formation on the surface 14. The controller then generates signals that activate the drive system coupled to transfer roller 94 to move the transfer roller into contact with the intermediate imaging member 12 to form transfer nip 92. The receiving substrate then enters the nip as the transfer roller 94 climbs the substrate and the image is transferred from the surface 14 of member 12 onto the receiving substrate for subsequent fusing at fusing device 60.

Figure 2:
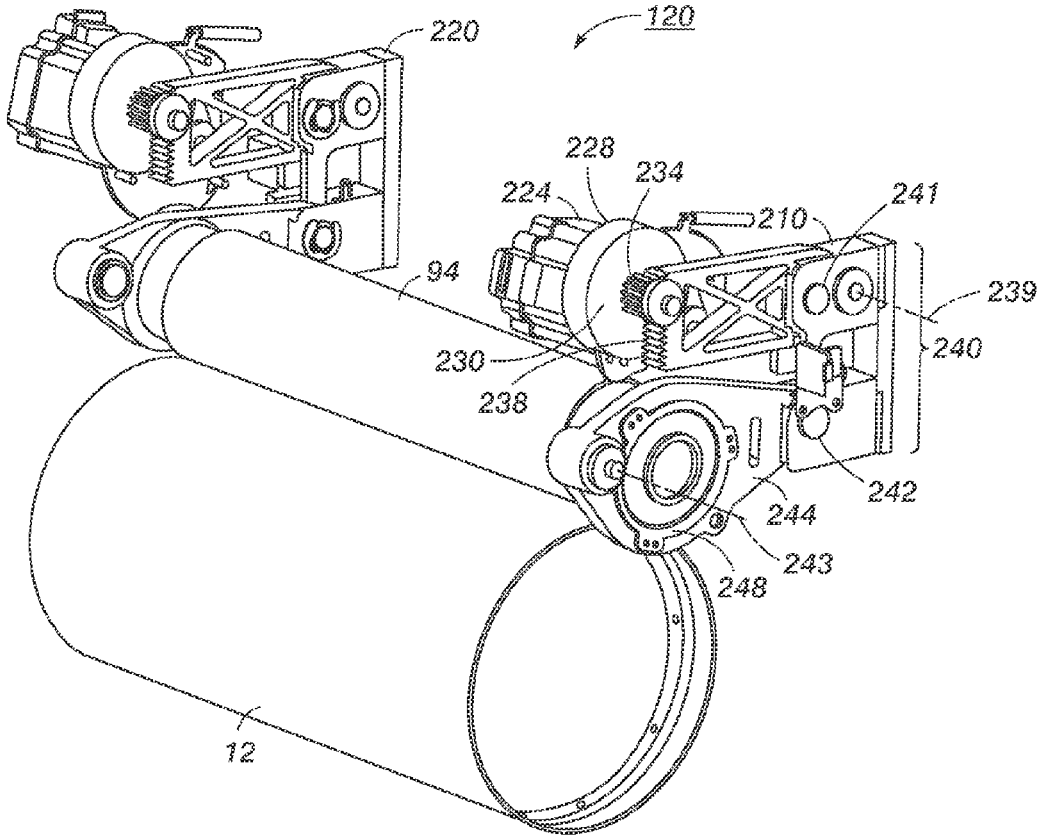
FIG. 2 PRIOR ART
FIG. 2 is a perspective view of a transfer roller electromechanical system for moving a transfer roller with reference to an imaging member.

A prior art transfer roller control system 120 for moving a transfer roller 94 with respect to an intermediate imaging member 12 is shown in FIG. 2. The system 120 includes a transfer roller control assembly 210 at one end of the transfer roller 94 and a transfer roller control assembly 220 at the other end of the transfer roller 94. As the transfer roller control assemblies 210 and 220 are essentially the same, the following description is directed to roller control assembly 210 only. The assembly 210 includes a motor 224 having a pulley (not shown) on its output shaft. An endless belt 228 is wound around the pulley on the output shaft of the motor 224 and pulley 230. At its center, pulley 230 has gear teeth 234 that engage teeth of a sector gear 238. At the outboard end of sector gear 238, a link 240 to a retainer arm 244 is mounted. Within the retainer arm 244 is an opening with a journal bearing 248 mounted therein to receive one end of the transfer roller 94. At the near end of the retainer arm 244 is a pivot pin, which allows the retainer arm 244 to rotate about the axis 243 as regulated by the motion of the link 240. The transfer roller control assembly 220 is similarly arranged.

When the controller generates a signal to operate the motor 224, its output shaft rotates causing the endless belt 228 to rotate the pulley 230. As pulley 230 rotates, the gear teeth 234 rotate the sector gear 238 about bearing axis 239. Link 240 at the outboard end of the sector gear 238 is coupled to the sector gear 238 by pivot pin 241 and coupled to retainer arm 244 by pivot pin 242. Rotation of section gear 238 urges the link 240 to move and link 240 urges the retainer arm 244 to rotate about the axis 243. Thus, the end of the transfer roller within bearing 248 is moved by bidirectional control of the motor 224. Operation of the motor 224 in the assembly 210 and the corresponding motor in the assembly 220 is coordinated by the controller so the transfer roller 94 moves smoothly into and out of engagement with the imaging member 12. In one embodiment, the operations of these motors are independently controlled. The assemblies 210 and 220 may also include sensors, such as a strain gauge mounted to link 240 or a sensor that measures deflections of link 240. The sensors in these assemblies provide an indication of the pressure being exerted by the transfer roller 94 against the imaging member 12. The pressure signals may be used by the controller as feedback for regulation of the signals controlling the motors in the assemblies 210 and 220 thereby regulating the force of transfer roller 94 against the imaging member 12.

While one embodiment of a transfer roller control assembly has been described, other embodiments may be used. The other embodiments may be comprised of a roller control assembly for each end of a transfer roller or it may be comprised of a single assembly that controls both ends of the transfer roller. What is required of the various transfer roller control embodiments is that the transfer roller control operates as a displaceable linkage to move the transfer roller into and out of engagement with the imaging member in response to control signals that move the linkage through a range of motion. The range of motion is defined at one end as being disengaged from the imaging member and, at the other end of the range, as being pressed against the imaging member with sufficient pressure to form a transfer nip.

Figure 3:
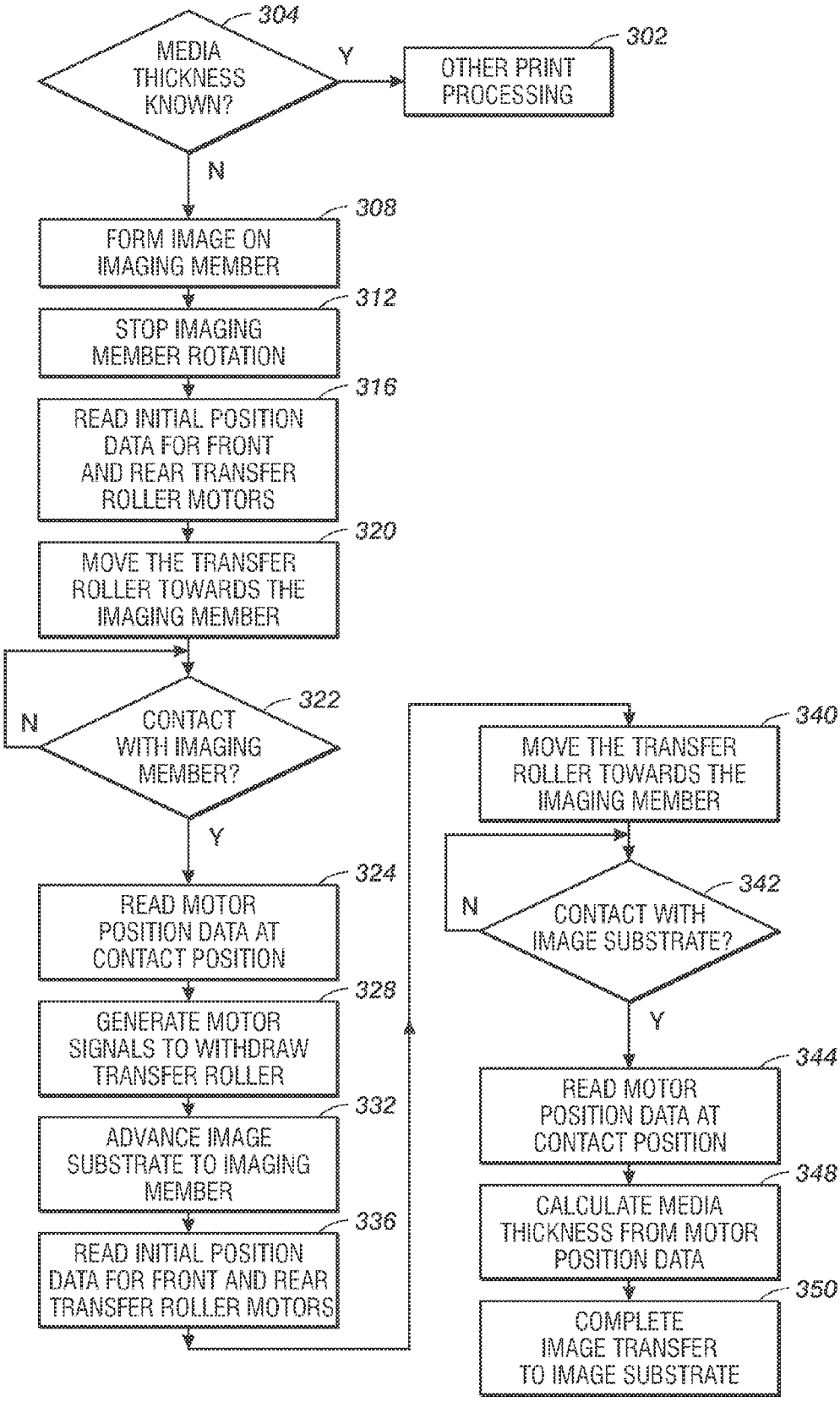
FIG. 3 is a flow diagram of a process for measuring thickness of an image substrate in a printer.
Figure 4:
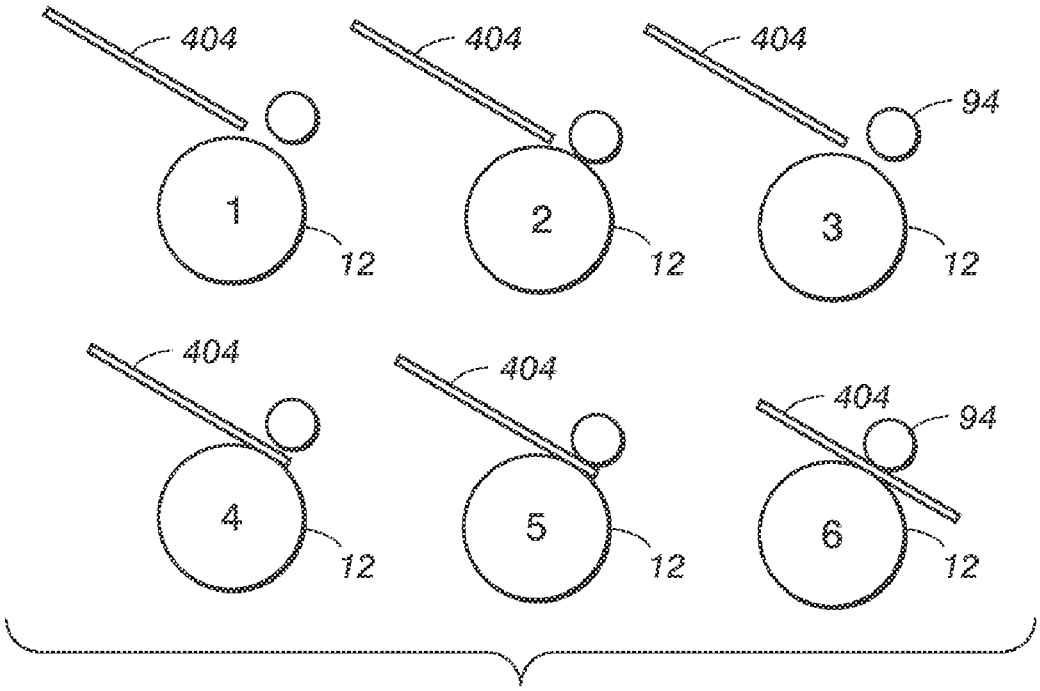
FIG. 4 is an illustration of the relationship between an imaging member and a transfer roller during the process shown in FIG. 3.

The system and method described more fully below operates the displaceable linkage to implement a method during the transfer phase, such as the one shown in FIG. 3. FIG. 4 depicts the physical relationship of the transfer roller 94 to the imaging member 12 during the process shown in FIG. 3. In the process 300, an event occurs that indicates a media thickness is unknown (block 304). Otherwise, the printer continues with its printing operations (block 302). The event may be, for example, a media sheet being selected from a bypass tray for an image, a media tray from which a sheet is retrieved for a print job being opened, or an imaging member drive belt slippage being detected. A print process is commenced and an image is formed on the imaging member (block 308). Rotation of the imaging member is halted a predetermined distance before reaching a position where a transfer nip would be formed during a print cycle (block 312). In one embodiment, the imaging member is stopped approximately 30 mm before the position where the transfer nip is typically formed. In this position, which is position 1 in FIG. 4, the media sheet is not completely advanced to a position where it contacts the imaging member. In this position, the controller reads the initial position of the motor that moves the front end of the transfer roller and the initial position of the motor that moves the rear end of the transfer roller (block 316). The controller generates a transfer load signal for each motor coupled to the ends of the transfer roller to move the transfer roller into contact with the imaging member to form a transfer nip (block 320). This position is shown in position 2 in FIG. 4. The transfer roller contacts the imaging member in the inter-image zone. The contact with the imaging member is detected by a pressure sensor generating a signal in response to the transfer roller contacting the imaging member. The generated signal corresponds to the pressure exerted against the transfer roller by the intermediate imaging member. Upon detection of this pressure signal exceeding a predetermined threshold indicative of imaging member contact (block 322), the controller reads the position of the motors that moved the front and rear ends of the transfer roller (block 324). The controller then generates a transfer unload signal and the motors are operated to withdraw the transfer roller from the contact position to its initial position (block 328) as shown in position 3 of FIG. 4.

The controller generates a media advance signal that activates the conveyor in the media path to advance the media sheet into the area where the transfer nip is formed (block 332) as shown in position 4 of FIG. 4. Preferably, the imaging member is not moved during the advancement of the media sheet to ensure little or no difference in the surface area of the imaging member that forms the transfer nip during the next measurement cycle. In one embodiment, however, small imaging member displacements of approximately 50 mm are deemed acceptable. The controller again reads the initial position of the motor that moves the front end of the transfer roller and the initial position of the motor that moves the rear end of the transfer roller (block 336). The controller then generates another transfer load signal for each motor coupled to the ends of the transfer roller to move the transfer roller towards the imaging member to form a transfer nip with the image substrate in the nip (block 340). This position is shown in position 5 in FIG. 4. The transfer roller contact with the image substrate in the transfer nip is detected by the pressure sensor signal exceeding the predetermined threshold indicative of imaging member contact (block 342). The controller reads the position of the motors that moved the front and rear ends of the transfer roller (block 344). The controller then uses the motor displacement readings to calculate the thickness of the media sheet (block 348) as described in more detail below. This measured thickness may be used to adjust printing parameters until an event occurs that may adversely impact the accuracy of the thickness measurement, such as the opening of the tray from which the measured media was retrieved. The controller then generates signals that complete the transfer of an image to the image substrate (block 350), which is depicted in position 6 of FIG. 4.

Figure 5:
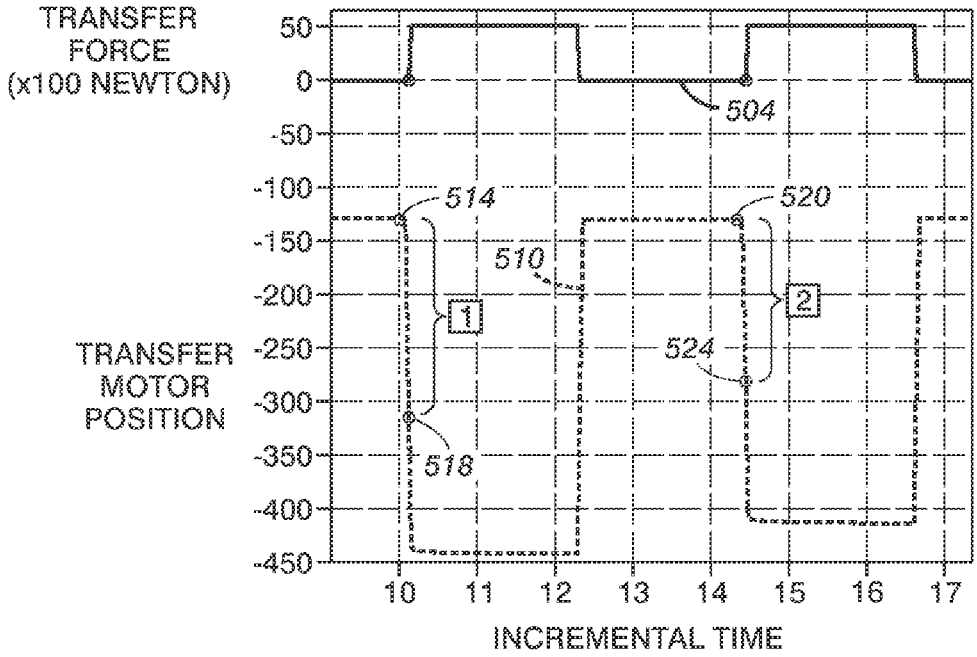
FIG. 5 is a graph depicting the motor displacement measurement points and the transfer force triggering points for the capture of data to calculate media thickness in a printer.

In the graph of FIG. 5, two lines are depicted to illustrate the process for measuring the media thickness. The upper line 504 is a graph of the force on the transfer roller exerted by the imaging member. When the transfer roller is withdrawn from the imaging member, the force is zero Newtons. When the transfer roller is fully loaded against the imaging member, the force is approximately 5100 Newtons (the units of force on the graph for line 504 is X100 Newtons). The predetermined threshold for detecting contact with the imaging member for this printer is 150 Newtons. The lower line 510 is a graph of the motor displacement during a transfer cycle. In one embodiment, the motors used are referred to as stepper motors because a predetermined number of steps equates to one revolution of the motor. For example, one embodiment uses a stepper motor that performs one revolution in 200 motor steps. The units for motor displacement shown in FIG. 5 are steps. Position 514 corresponds to the motor initial position and position 518 corresponds to the motor displacement at the time that the transfer roller contact with the imaging member is detected. Similarly, the next transfer cycle, in which the image substrate is positioned within the transfer nip, includes position 520 and position 524, which correspond, respectively, to the initial motor position and the motor position at the detection of the transfer roller contacting the media in the transfer nip. The difference between the number of steps at position 518 and 514 provides a measurement of the motor displacement during a transfer cycle in which no media sheet is in the nip, while the difference between the number of steps at position 524 and 520 provides a measurement of the motor displacement during a transfer cycle in which a media sheet is positioned within the nip. The difference between the two differences identifies a measurement of the thickness of the media.

Figure 6:
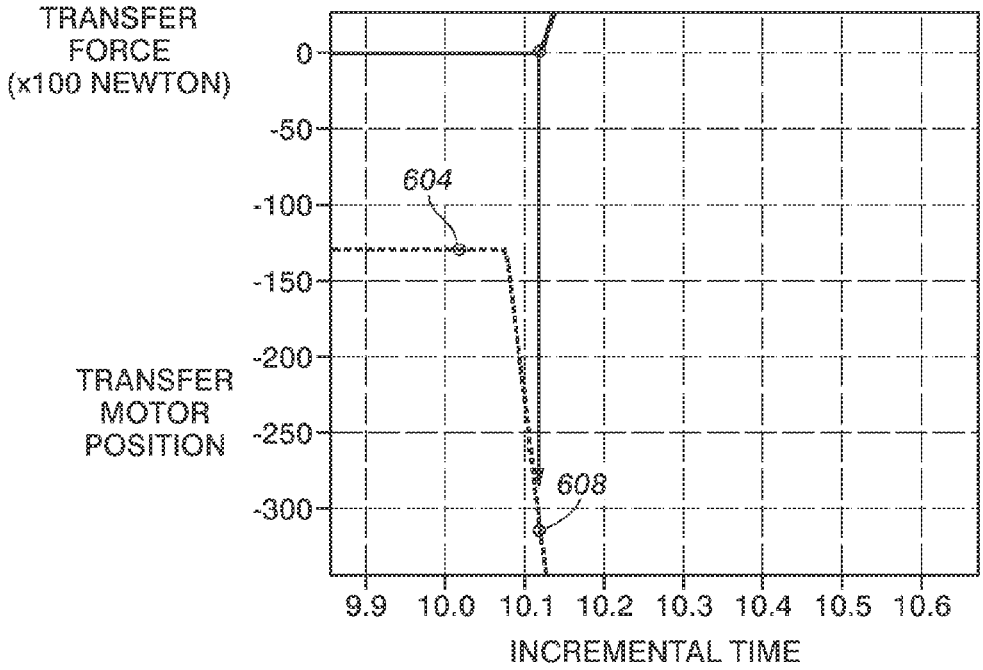
FIG. 6 is a portion of the graph shown in FIG. 5 in greater detail.

The first transfer cycle is shown in greater detail in FIG. 6. At position 604, the controller reads the initial position of the motor and begins monitoring the force on the transfer roller. When the transfer force exceeds the predetermined threshold of 150 Newtons, the motor position (position 608) is sampled again. In one embodiment, the displacements of both the motor for the front end of the transfer roller and the motor for the rear end of the transfer roller are measured. An equation describing the measurement calculation based on the relative displacement of the front and rear motors may be expressed as:

$$t=[(D2F-S2F-D1F+S1F)+(D2R-S2R-D1R+S1R)]/2/SF.$$

where t is the media thickness, S1F and S1R are the start positions of the front and rear, respectively, motors for the first transfer cycle, S2F and S2R are the start positions of the front and rear, respectively, motors for the second transfer cycle, D1F and D1R are the contact positions of the front and rear, respectively, motors for the first transfer cycle, D2F and D2R are the contact positions of the front and rear, respectively, motors for the second transfer cycle, and SF is a scaling factor for converting motor steps to linear measurement units. In one embodiment, the scaling factor is 170.4549 steps/mm. Division by two provides a mean average of the two motor displacements. The reader should note that the mechanical start positions S1F and S2F for the front motor and S1R and S2R for the rear motor are constants. In the case where the frame of reference for measuring displacement is unchanged, the relative start position values are equal and the thickness can be calculated using only the absolute motor positions. The previous equation can then be reduced as follows:

$$S1F=S2F \text{ and } S1R=S2R \text{ so } t=[(D2F-D1F)+(D2R-D1R)]/2/SF.$$

An example of a thickness calculation is illustrated in the following table:

| |
|---|
| t = [(D2F − S2F − D1F + S1F) + (D2R − S2R − D1R + S1R)]/2/SF |
| D1F = −327.5938 |
| D2F = −293.4688 |
| S1F = −135.5000 |
| S2F = −135.4375 |
| D1R = −315.5938 |
| D2R = −281.6563 |
| S1R = −129.6563 |
| S2R = −129.7188 |
| t = 0.1997 mm |

The actual media thickness in this example was 0.21 mm. Consequently, the calculated media thickness had an error of −5%.

Using empirical methodologies, various parameters controlling the measurement process, such as transfer roller velocity, transfer roller contact force threshold, and force sampling rate, were experimented with to determine more optimal values for improved measurement accuracy. Further improvements were made by using linear regression techniques that resulted in the inclusion of an offset and a gain in the final equation. The final modified equation based on relative displacements may be expressed as:

$$t=\{[[(D2F-S2F-D1F+S1F)+(D2R-S2R-D1R+S1R)]/2/SF]-\text{Offset}\}/\text{Gain};$$

or based on absolute displacements may be expressed as:

$$t=\{[[(D2F-D1F)+(D2R-D1R)]/2/SF]-\text{Offset}\}/\text{Gain}.$$

The empirically derived parameters were determined to be a minimum sampling rate of 1.5 kHz, a maximum transfer roller velocity of 10 mm/second, an imaging member contact threshold of 450 Newtons, a scaling factor of 170.4549 steps/mm, an offset of −0.016390 mm, and a gain of 1.028331. These changes are predicted to improve the accuracy of the media thickness measurements to within approximately 5.4% and yielded a resolution of approximately 6.5 microns. While this accuracy change is not an improvement over the example yielding the 5% error described above, the application of the empirically derived parameters across a population of printers is thought to provide a statistically significant improvement in accuracy over the measurements made by printers not utilizing such parameters.

In operation, a controller is configured with programmed instructions to implement the process described above. During a print cycle, the controller detects an event necessitating measurement of an image substrate and generates the signals to operate the transfer roller through two transfer cycles. In one cycle, the motor displacement is measured without media being in the transfer nip, and in the other cycle, the motor displacement is measured with media in the transfer nip. Using a thickness equation with appropriate parameters, the controller calculates the thickness of the media and thereafter uses the thickness for adjusting print process parameters.

Those skilled in the art will recognize that numerous modifications can be made to the specific implementations described above. It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. A printer comprising:

an intermediate imaging member;

a transfer roller located proximate to the intermediate imaging member;

a displaceable linkage coupled to the transfer roller to move the transfer roller from a first position to a position at which the transfer roller engages the intermediate imaging member to form a transfer nip with the intermediate imaging member and to return the transfer roller to the first position; and a controller coupled to the displaceable linkage, the controller being configured to measure movement of the transfer roller from the first position to the position where the transfer nip is formed, and to compute a media thickness from a measured movement of the transfer roller from the first position to the position where the transfer nip is formed with the intermediate imaging member without an image substrate being in the transfer nip and a measured movement of the transfer roller from the first position to the position where the transfer nip is formed with an image substrate in the transfer nip between the transfer roller and the intermediate imaging member.

2. The printer of claim 1 further comprising:

a force sensor coupled to the transfer roller to measure a force received by the transfer roller from the intermediate imaging member; and the controller being configured to measure movement of the transfer roller in response to the force measured by the force sensor exceeding a predetermined threshold.

3. The printer of claim 1, the controller being further configured to measure movement of one end of the transfer roller from the first position to the position where the transfer nip is formed, and to measure movement of another end of the transfer roller from the first position to the position where the transfer nip is formed, the media thickness being computed as a mean average of a difference between the measured movement of the one end of the transfer roller from the first position to the position where the transfer nip is formed with the intermediate imaging member with and the measured movement without an image substrate being in the transfer nip and a difference between the measured movement of the other end of the transfer roller from the first position to the position where the transfer nip is formed with an image substrate with and the measured movement without an image substrate being in the transfer nip.

4. The printer of claim 1 further comprising:

at least one media tray;

a sensor detecting opening and closing of the media tray; and the controller being coupled to the sensor and the controller being configured to measure movement of the transfer roller and compute the media thickness in response to the sensor detecting the opening of the media tray.

5. The printer of claim 1 further comprising:

a sensor detecting slippage of a drive belt coupled to the intermediate imaging member; and the controller being coupled to the sensor and the controller being configured to measure movement of the transfer roller and compute the media thickness in response to the sensor detecting slippage of the drive belt.

6. The printer of claim 1, the controller being further configured to adjust a printing process parameter with reference to the computed media thickness.

7. The printer of claim 6, the controller being further configured to adjust a force applied to the transfer roller to move the transfer roller from the first position to the position where the transfer nip is formed with the intermediate imaging member.

8. The printer of claim 1, the displaceable linkage comprising:

a retainer arm for rotatably holding one end of the transfer roller;

a link coupled to the retainer arm;

a sector gear coupled to the link to move the link and retainer arm;

a gear having teeth that intermesh with the sector gear; and a motor having a rotating output shaft that is coupled to the gear, the controller being coupled to the motor to measure motor displacement during movement of the transfer roller from the first position to the position where the transfer nip is formed with the intermediate imaging member and to correlate the measured motor displacement to a transfer roller movement measurement.

9. A method for moving a transfer roller during a print cycle comprising:

measuring a first movement of a transfer roller from a first position to a position where the transfer roller contacts an intermediate imaging member to form a transfer nip;

measuring a second movement of a transfer roller from the first position to a position where the transfer roller contacts an image substrate in the transfer nip; and computing a thickness for the image substrate from the first measured movement and the second measured movement.

10. The method of claim 9, the measurement of the first movement and the measurement of the second movement being made in response to a force exerted on the transfer roller by the intermediate imaging member being greater than a predetermined threshold.

11. The method of claim 9, the first movement measurement further comprising:

measuring movement of one end of the transfer roller from the first position to the position where the transfer roller contacts the intermediate imaging member to form the transfer nip and measuring movement of another end of the transfer roller from the first position to the position where the transfer roller contacts the intermediate imaging member to form the transfer nip;

the second movement measurement further comprising:

measuring movement of the one end of the transfer roller from the first position to the position where the transfer roller contacts the image substrate in the transfer nip and measuring movement of the other end of the transfer roller from the first position to the position where the transfer roller contacts the image substrate in the transfer nip; and the computation of the image substrate thickness further comprising:

computing a first thickness for the image substrate from the measured movement for the one end from the first position to the position where the transfer nip is formed and the measured movement for the one end from the first position to the position where the transfer roller contacts the image substrate;

computing a second thickness for the image substrate from the measured movement for the other end from the first position to the position where the transfer nip is formed and the measured movement for the other end from the first position to the position where the transfer roller contacts the image substrate; and calculating a mean average of the first thickness and the second thickness as the thickness of the image substrate.

12. The method of claim 9 further comprising:

detecting a media tray being opened; and measuring the first movement and the second movement in response to the detected media tray opening.

13. The method of claim 9 further comprising:

detecting slippage of a drive belt coupled to the intermediate imaging member; and measuring the first movement and the second movement in response to the detected drive belt slippage.

14. The method of claim 9 further comprising:

adjusting a printing process parameter with reference to the computed media thickness.

15. The method of claim 14 wherein the adjusted printing process parameter is a force applied to the transfer roller to move the transfer roller to the position where a transfer nip is formed between the transfer roller and the intermediate imaging member.

16. The method of claim 9, the measurement of the first movement and the measurement of the second movement further comprising:

measuring displacement of a motor coupled to the transfer roller as the motor moves the transfer roller from the first position to the position where the transfer nip is formed; and correlating the motor displacement to the measured first movement and to the measured second movement.

17. A printer comprising:

a print drum for receiving ink ejected by at least one printhead;

a transfer roller located proximate to the print drum;

a displaceable linkage coupled to the transfer roller to move the transfer roller from a first position to a position in which the transfer roller forms a transfer nip with the intermediate imaging member and to return the transfer roller to the first position, the displaceable linkage comprising:

a retainer arm for rotatably holding one end of the transfer roller;

a link coupled to the retainer arm;

a sector gear coupled to the link to move the link and retainer arm;

a gear having teeth that intermesh with the sector gear; and a motor having a rotating output shaft;

a controller coupled to the displaceable linkage, the controller being configured to measure movement of the transfer roller from the first position to the position where the transfer nip is formed, and to compute a media thickness from a measured movement of the transfer roller from the first position to the position where the transfer nip is formed with the intermediate imaging member without an image substrate being in the transfer nip and a measured movement of the transfer roller from the first position to the position where the transfer nip is formed with an image substrate in the transfer nip between the transfer roller and the intermediate imaging member.

18. The printer of claim 17 further comprising:

a force sensor coupled to the transfer roller to measure a force received by the transfer roller from the intermediate imaging member; and the controller configured to measure movement of the transfer roller in response to the force measured by the force sensor exceeding a predetermined threshold.

19. The printer of claim 17, the controller being further configured to measure movement of one end of the transfer roller from the first position to the position where the transfer nip is formed, and to measure movement of another end of the transfer roller from the first position to the position where the transfer nip is formed, the media thickness being computed as a mean average of the difference between the measured movement of the one end of the transfer roller from the first position to the position where the transfer nip is formed with the intermediate imaging member with an image substrate and the measured movement of the one end of the transfer roller from the first position to the position where the transfer nip is formed with the intermediate imaging member without an image substrate being in the transfer nip and the difference between the measured movement of the other end of the transfer roller from the first position to the position where the transfer nip is formed with an image substrate with an image substrate and the measured movement of the one end of the transfer roller from the first position to the position where the transfer nip is formed with the intermediate imaging member without an image substrate being in the transfer nip.

20. The printer of claim 1 further comprising:

at least one media tray;

a sensor detecting opening and closing of the media tray; and the controller being coupled to the sensor and the controller being configured to measure movement of the transfer roller and to compute the media thickness in response to the sensor detecting the opening of the media tray.

* * * * *